US007694374B2

(12) United States Patent
Jones et al.

(10) Patent No.: US 7,694,374 B2
(45) Date of Patent: Apr. 13, 2010

(54) MODULAR-BRIDGE CONSTRUCTION

(75) Inventors: Douglas Hugh Jones, Salisbury (GB); Ian John Dunn, Malvern (GB); Colin Peter Morgan, Farnborough (GB); Scott Ardley, Farnborough (GB); Linda Mary Patricia Starink, Farnborough (GB)

(73) Assignee: Qinetiq Limited (GB)

( * ) Notice: Subject to any disclaimer, the term of this patent is extended or adjusted under 35 U.S.C. 154(b) by 572 days.

(21) Appl. No.: 11/701,922

(22) Filed: Feb. 2, 2007

(65) Prior Publication Data

US 2007/0180635 A1 Aug. 9, 2007

(30) Foreign Application Priority Data

Feb. 4, 2006 (GB) ..... 0602291.7

(51) Int. Cl.
*E01D 15/12* (2006.01)

(52) U.S. Cl. ..... 14/2.4; 14/69.5; 14/77.1; 182/116; 182/119

(58) Field of Classification Search ..... 14/2.4–2.6, 14/74.5, 27; 182/116–118, 123, 130–131, 182/152

See application file for complete search history.

(56) References Cited

U.S. PATENT DOCUMENTS

| | | | | | |
|---|---|---|---|---|---|
| 11,467 | A | * | 8/1854 | Baldwin | 14/74.5 |
| 1,629,787 | A | * | 5/1927 | Hackett | 52/175 |
| 1,748,309 | A | * | 2/1930 | Rose | 104/28 |
| 2,336,622 | A | * | 12/1943 | Le Tourneau | 14/74.5 |
| 3,239,862 | A | * | 3/1966 | Hire | 14/2.4 |
| 3,504,389 | A | * | 4/1970 | Longbottom | 14/13 |
| 4,080,681 | A | * | 3/1978 | Olrik et al. | 14/74.5 |
| 5,495,631 | A | * | 3/1996 | Connor et al. | 14/2.6 |
| 5,511,268 | A | * | 4/1996 | Albus et al. | 14/77.1 |
| 6,003,183 | A | * | 12/1999 | Ghering | 14/2.4 |
| H1872 | H | * | 10/2000 | Bowman | 156/172 |

FOREIGN PATENT DOCUMENTS

| | | |
|---|---|---|
| DE | 20 2005 000 646 | 5/2001 |
| EP | 0 259 202 | 3/1988 |
| GB | 2 285 472 | 7/1995 |
| GB | 2 311 321 | 9/1997 |

OTHER PUBLICATIONS

English Abstract of DE 20 2005 000 646 provided by EPODOC/EPO.

* cited by examiner

*Primary Examiner*—Raymond W Addie
(74) *Attorney, Agent, or Firm*—McDonnell Boehnen Hulbert & Berghoff LLP

(57) ABSTRACT

Disclosed is a modular bridge, typically for temporary use to enable persons to pass between upper floors of adjacent buildings during fire fighting or disaster relief operations, which can be rapidly assembled and deployed within a confined space and entirely from the "home" side of the gap to be crossed. It comprises a plurality of man-portable box section bridge modules adapted to be connected together end to end and projected in cantilever fashion from one side of the gap to the other. The assembly of modules is supported in and guided through a launch frame, with modules being added to the rear of the assembly and pushed through the frame until the gap is spanned. Removable lever arms of the frame are used to counterbalance the weight of the projected bridge modules during the course of deployment.

19 Claims, 12 Drawing Sheets

MODULAR-BRIDGE CONSTRUCTION

BACKGROUND OF THE INVENTION

The present invention relates to modular bridge construction.

More particularly (though not exclusively) the invention seeks to provide a means for enabling personnel to pass across gaps e.g. within damaged or partially collapsed buildings or between upper floors of adjacent buildings when passage through the lower floor(s) of either or both is too difficult or dangerous, which can be rapidly assembled and deployed, typically within a confined space and entirely from the "home" side of the gap. Such capability may be required for example during firefighting, disaster relief or the like search and recovery operations, or certain military operations. Heretofore the only devices which have been generally available for such service are conventional ladders. Ladders are not, however, designed to carry the loads which are likely to be encountered when used as a bridge, are difficult and dangerous to cross when laid horizontally, offer limited span capability and/or may be too unwieldy to be carried through buildings.

SUMMARY OF THE INVENTION

In one aspect the invention accordingly resides in means for the construction of a bridge comprising: a plurality of man-portable bridge modules adapted to be connected together in linear succession, on one side of a gap to be spanned, and projected in cantilever fashion from that side of the gap until the assembly of modules spans the gap to form a bridge capable of supporting human traffic; and a man-portable apparatus, or plurality of man-portable components adapted to be assembled into an apparatus, adapted to support and guide the cantilevered assembly of bridge modules as it is projected across the gap.

A bridge constructed from modules as defined above may be used for the kind of service discussed above or more generally for gap crossing in emergency, tactical or other scenarios, including use not only where the main span of the bridge is supported above the ground but also use as trackway laid upon mud flats or other unstable ground for example. Although intended principally for foot traffic, bridges constructed in accordance with the invention may also be crossed e.g. by use of a dedicated trolley system, as will be exemplified hereinafter. It is also possible that pairs of such bridges deployed in parallel could be used for crossing by conventional light motorised vehicles.

The term "man-portable" implies that the weight of each such module, component or apparatus is not more than about 40 kg and is of a bulk to be amenable to carrying on the back or otherwise by a person. In a preferred embodiment to be described hereinafter two bridge modules can be carried simultaneously by one person and all the components to be assembled into an associated support/guidance apparatus can be carried together by one person.

The bridge modules are preferably connected together demountably. They may be of generally rectangular box section, the upper surfaces of which collectively define a substantially continuous deck. In the preferred embodiment to be described hereinafter the bridge modules are basically open ended, although if required additional torsional rigidity can be obtained by closing the ends of the modules. In any event brackets to resist shear loads may be attached internally of the box section e.g. between side and lower surfaces of the respective module, or otherwise as necessary to react the applied loads. Adjacent modules may be connected together in the region of their lower surfaces by pin joints extending transversely to the longitudinal direction of the bridge and so that upper portions of adjacent modules abut under longitudinal compression in normal use of the bridge. They may be connected together in the region of their upper surfaces by links adapted to resist the longitudinal tension between adjacent modules which arises while projected in cantilever fashion.

The bridge modules are preferably constructed principally of a fibre reinforced plastic material, and more particularly of sandwich material comprising skins of fibre reinforced plastic separated by a core material, and an exemplary manufacturing technique will be described hereinafter.

The apparatus for use in supporting and guiding the cantilevered assembly of bridge modules may be adapted for free-standing use on a supporting surface and may comprise a receiving portion through which bridge modules can be passed successively to project the assembly and within which the proximal end of the assembly is supported, and lever arm means adapted to be held by one or more persons and extending from the receiving portion in the direction opposite to the direction in which the assembly of bridge modules is projected, to counterbalance the projected assembly. In use the receiving portion may also be tilted by operation of the lever arm means to raise or lower a projected assembly of bridge modules.

The receiving portion of such apparatus may comprise rollers adapted to bear the bridge modules for translation, while the receiving portion and bridge modules may be adapted to interlock to prevent movement of the modules when required.

The invention also resides in a method of constructing a bridge capable of supporting human traffic by use of means defined above, which comprises connecting such bridge modules together in linear succession, on one side of a gap to be spanned, and projecting the assembly of modules in cantilever fashion from that side of the gap until such assembly spans the gap to form the bridge, while supporting and guiding the cantilevered assembly of bridge modules with said apparatus.

A preferred construction method utilising the preferred form of apparatus described above comprises the steps of:

(a) loading one or more bridge modules into the receiving portion of said apparatus;

(b) connecting one or more further bridge modules to the proximal end of the first-mentioned module or assembly of modules and shifting the resultant assembly of modules with respect of said receiving portion so that the distal end of the assembly projects from the apparatus while the proximal end of the assembly is supported in the receiving portion; and (c) connecting one or more further bridge modules to the proximal end of the existing assembly of modules and shifting the resultant assembly with respect to said receiving portion so that its distal end projects further from the apparatus while its proximal end is supported in said receiving portion; and (d) repeating step (c), if necessary, until said assembly spans the gap;

all while counterbalancing the projected assembly of bridge modules by use of said lever arm means.

Construction of a bridge in accordance with the invention is preferably accomplished solely by manpower.

The invention also resides per se in a bridge constructed by the means and/or method defined above, and in a bridge module and in a support/guidance apparatus forming part of the means defined above.

In another aspect the invention resides in a plurality of man-portable bridge modules adapted to be connected together in linear succession to span a gap, and capable of supporting at least human traffic, wherein each such module is of generally rectangular box section and constructed principally of a fibre reinforced plastic material.

These and other aspects and features of the present invention will now be more particularly described, by way of example, with reference to the accompanying drawings.

DETAILED DESCRIPTION

Figure 1:
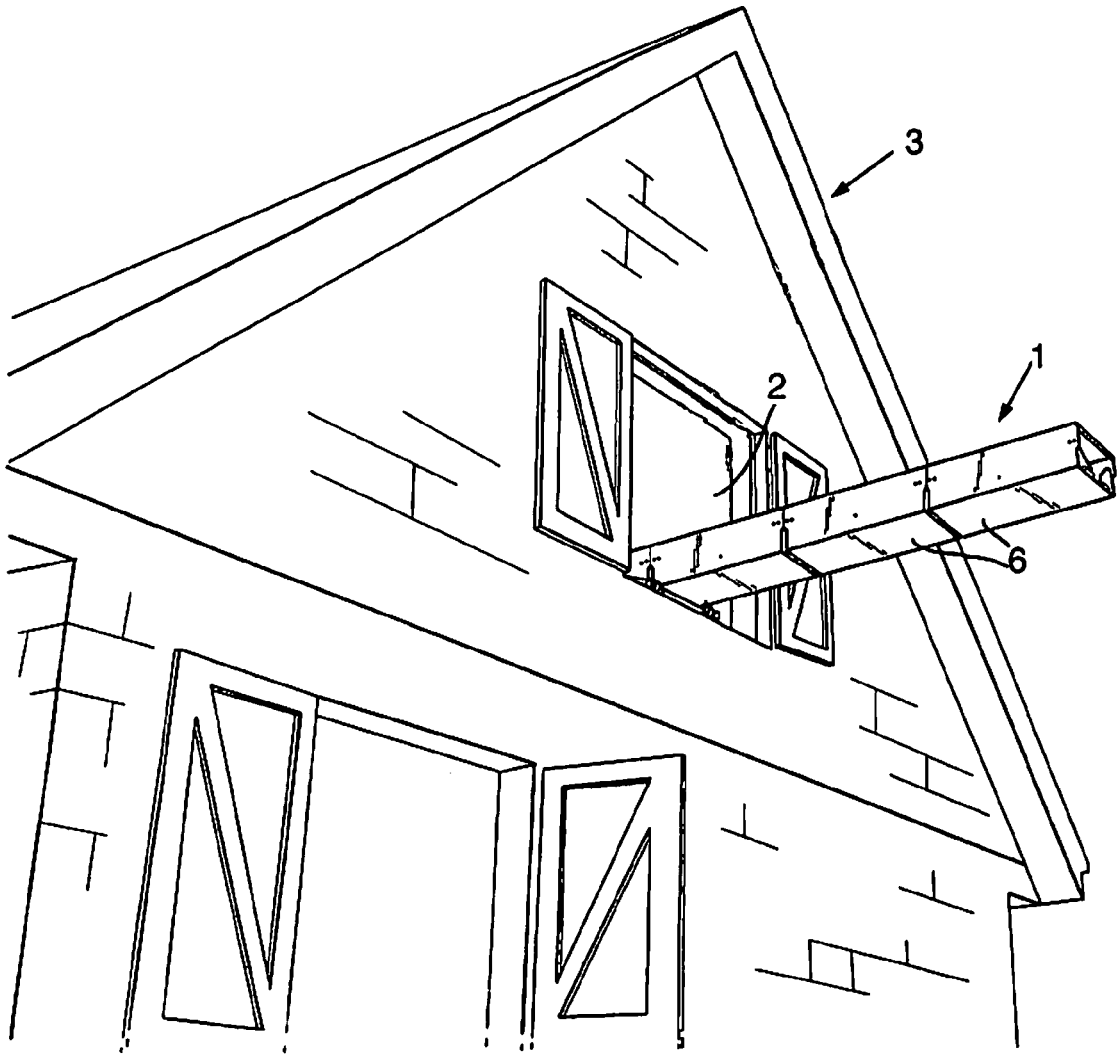
FIG. 1 is a perspective view of a preferred from of modular foot bridge according to the invention in the course of deployment.
Figure 2:
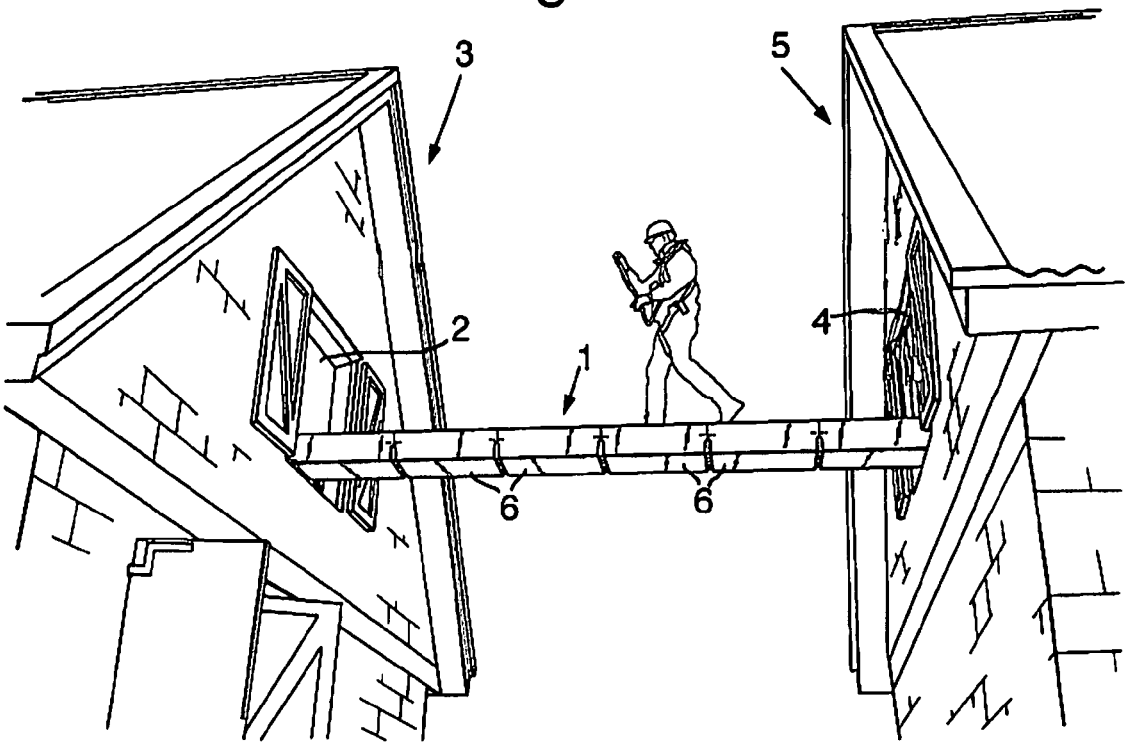
FIG. 2 is a perspective view of the completed bridge in use.

Referring to FIG. 1 there is shown a modular bridge 1 according to the invention in the course of deployment through an upper window 2 of a building 3 and FIG. 2 shows the completed bridge spanning the gap between window 2 and an upper window 4 of an adjacent building 5 to that personnel can pass on foot between the two buildings. The bridge is constructed from a series of identical modules 6 connected together end to end and projected through the window 2 in cantilever fashion as further modules are added to the assembly until it reaches across the gap to window 4, all as will be more particularly described below.

Figure 3:
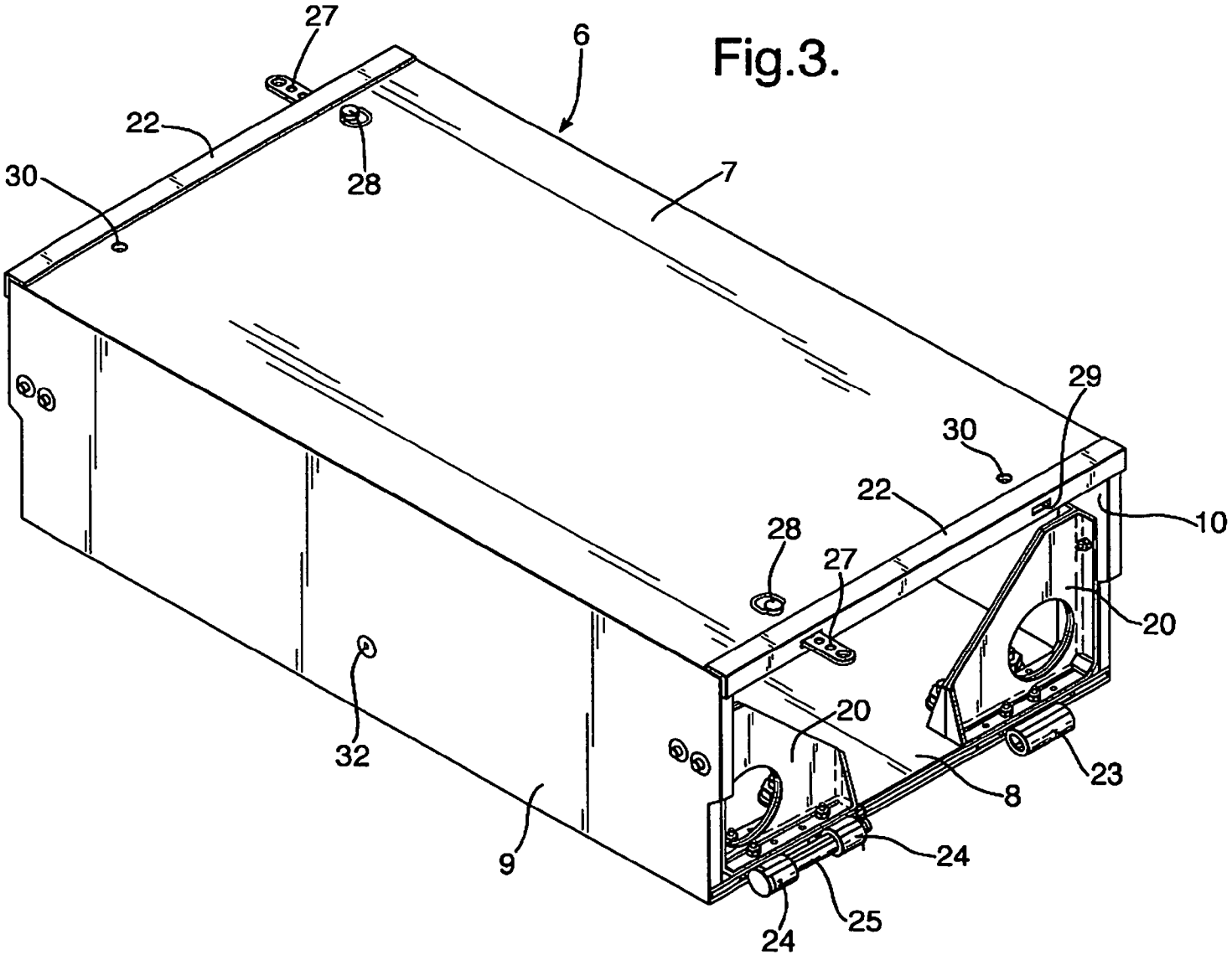
FIG. 3 is a three-quarters view of a preferred embodiment of a bridge module according to the invention.
Figure 4:
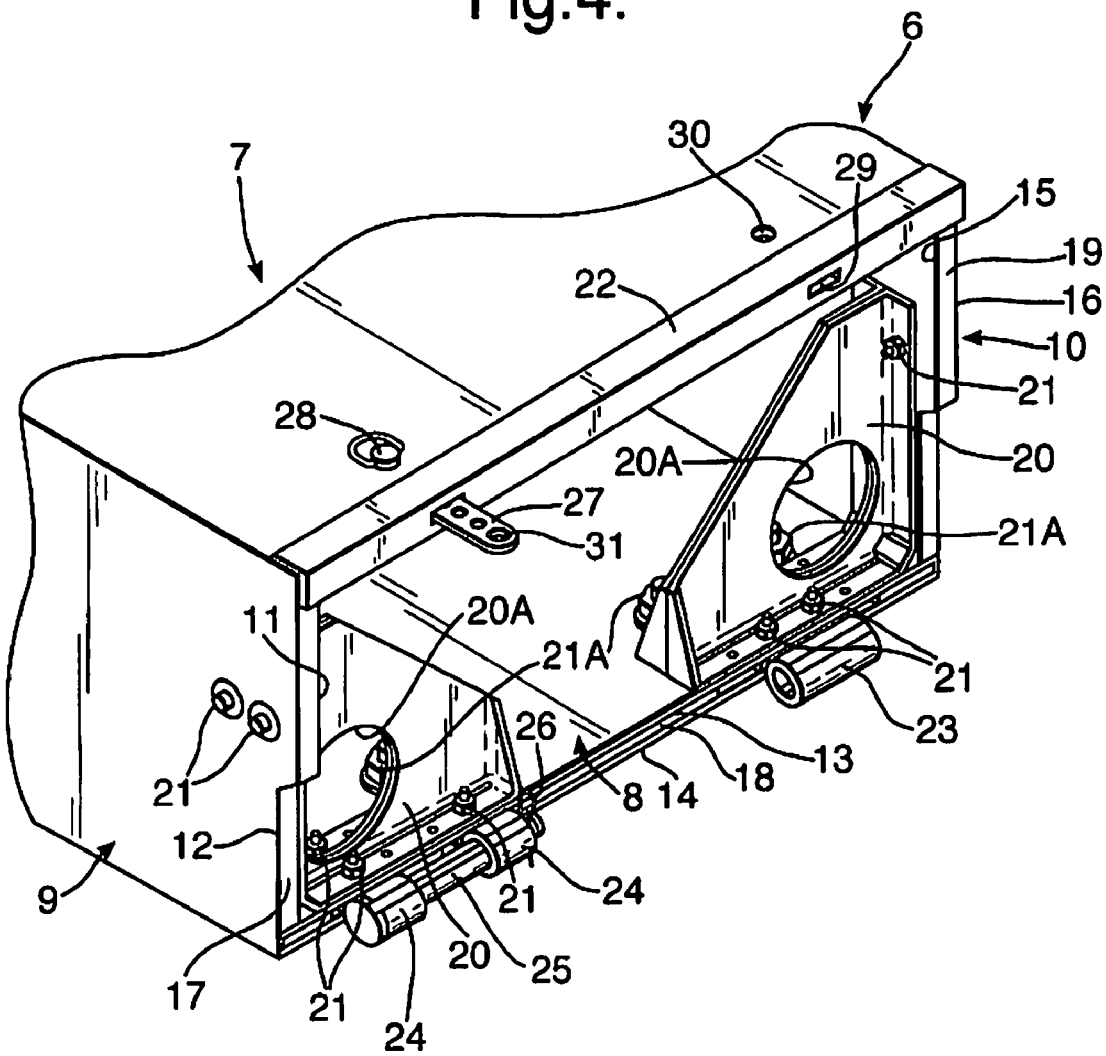
FIG. 4 shows part of the module of FIG. 3 to a larger scale.

A typical bridge module 6 is shown in greater detail in FIGS. 3 and 4. It is basically an open ended rectangular box structure having an upper chord 7 providing the deck surface of the bridge, a lower chord 8 and two side webs 9 and 10. The main body of the module, consisting of chords and webs 7-10, is made of carbon fibre reinforced plastic (CFRP) sandwich panels, comprising inner and outer CFRP skins (such as 11-16 in FIG. 4) bonded to a lightweight core of e.g. balsa or foam (such as 17-19 in FIG. 4). This form of construction and material selection is preferred for its high stiffness to weight ratio and is also of advantage in achieving a natural frequency for the completed bridge which will not be excited by foot traffic (preferably at least 7 Hz).

In a preferred embodiment the bridge module bodies are manufactured with a single resin infusion step for all of the chords/webs 7-10 using the RIFT (resin infusion under flexible tooling) technique and employing an internal tool and external bag to allow infusion of liquid resin through dry preforms under vacuum pressure. More particularly plies of carbon fibre fabric for the inner skins are wrapped around a rectangular box-like tool; the sandwich cores, optionally wrapped in carbon fibre fabric, are added in sections; and further carbon fibre plies for the outer skins are wrapped around the assembly. The whole is then wrapped in porous PTFE which helps to keep the preforms together, provides an air path and prevents the vacuum bag from sticking to the component. The vacuum bag is then added and as the module body is hollow a twin bag technique is used with the edges of the inner and outer tubular bag sections being joined together and the resin infusion pipe being brought in through the joint line. The bag is placed under vacuum from one end of the component and resin is drawn through the carbon fibre preforms from the other end until it is infused through all of the plies. Once cured, the basic module body can be de-moulded and finished.

The basic box structure of the bridge module is strengthened against shear loads by pairs of corner brackets 20 at each end (only one end seen in FIGS. 3 and 4). The illustrated apertures 20A in these brackets also provide convenient hand holds by which the modules can be picked up and maneuvered into place when assembling a bridge. The brackets may be manufactured as monolithic CFRP components and are each glued and bolted (bolts 21 are seen in FIG. 4) to the lower chord 8 and to the respective adjacent web 9 or 10. A CFRP strip 22 is bonded to the edge of the upper chord 7 at each end of the main body to protect the otherwise exposed edge of the sandwich material at that position from damage by the abutting edge of the neighbouring module in use of an assembled bridge, it being understood that these top edges of the box structures will be placed under longitudinal compression by bending loads on the bridge when trafficked as in FIG. 2.

Joints at the lower chords 8 connect adjacent modules 6 together and resist the tension loads between modules when the bridge is trafficked. In the illustrated embodiment these joints comprise, at each end of each module, a single transverse tubular (male) lug 23 and a spaced pair of transverse tubular (female) lugs 24, arranged so that when adjacent modules are placed end to end each male lug 23 lies between the female lugs 24 of its neighbour. These lugs are attached to the respective modules by integral flanges (not seen in the Figures) slotting between the CFRP skins 13,14 of the chord 8 (the core material 18 being locally removed for the purpose) and glued and bolted in place (sharing the bolts 21 by which the adjacent corner brackets 20 are attached to the chord 8 plus additional, larger bolts 21A to transfer loads between the joints and modules). The joints are completed when assembling modules 6 together by pins inserted through the aligned female/male lugs. One such pin 25 is shown in the female lugs 24 in the Figures in the position which it will adopt when the respective joint is completed and in which it can be conveniently stowed when not in use—it then being understood that the pin 25 is first removed from the lugs 24 to permit reception of the neighbouring module's male lug 23 before reinsertion through all three. A conventional "R" clip 26 is also shown for holding the pin 25 in place. For maximum trade-off between strength and weight the lugs 23,24 may be of aluminium alloy while the pins 25 are of stainless steel. As shown in the Figures the length of the lower chord 8 of the box structure is slightly less than that of the upper chord 7, with the edges of the webs 9 and 10 being profiled at each end to match, so that the centre lines of the lugs 23 and 24 are vertically below the edges of the compression strips 22 at each end.

Joints are also provided for connecting adjacent modules 6 together at the upper chords 7, it being understood that while these are normally under compression in use of an assembled bridge (FIG. 2) there will be longitudinal tension loads to meet at the upper chords under the weight of the assembled modules while they are cantilevered during deployment (FIG. 1). In the illustrated embodiment the top joints comprise, at each end of each module, a steel link 27 received in a slot between the CFRP skins of the chord 7 and held in place by a conventional bullet pin 28 inserted through a hole drilled through the thickness of the chord 7 and an aligned hole (not seen) in the link 27. When adjacent modules are placed end to end each link 27 extends into an aligned slot 29 between the CFRP skins of the chord 7 of its neighbour and the joints are completed by further bullet pins (not shown) inserted through holes 30 drilled through the chords 7 and aligned holes 31 (FIG. 4) at the ends of the links 27.

Holes 32 (one seen in FIG. 3) are also drilled through the thickness of each web 9 and 10 for a purpose to be described hereinafter.

Figure 5:
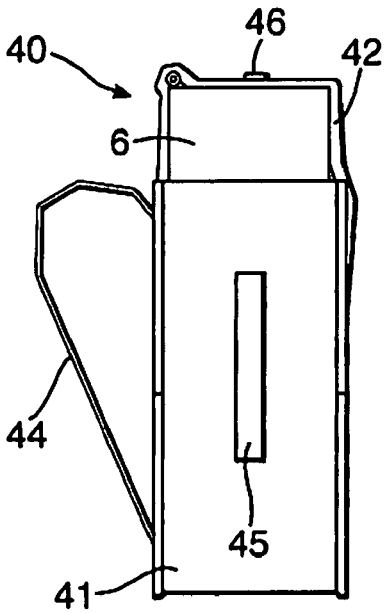
FIGS. 5 and 6 are side and rear views of a rucksack for carrying a bridge module according to the invention.
Figure 6:
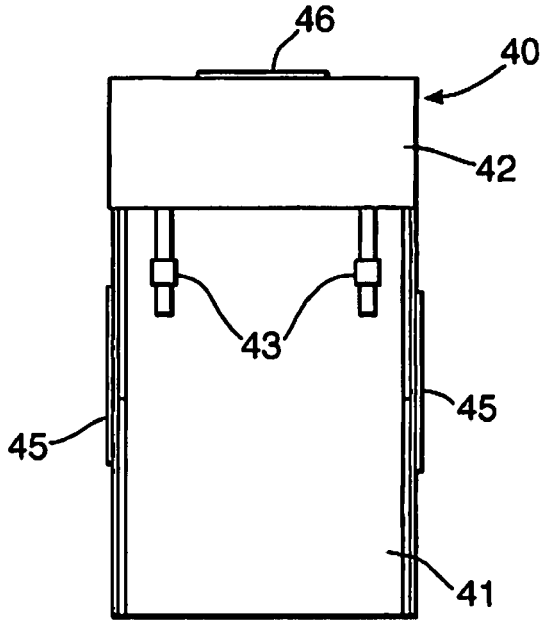
Figure 7:
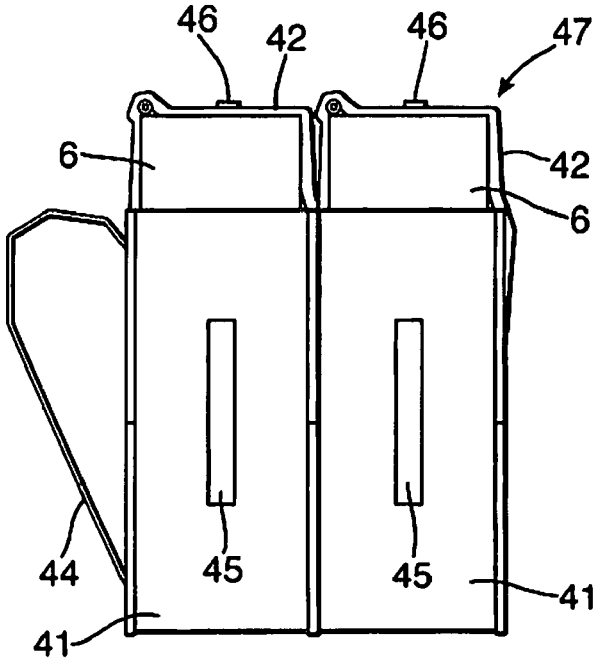
FIG. 7 is a side view of a rucksack for carrying two such modules.

In one embodiment of the invention constructed substantially as described above with reference to FIGS. 3 and 4, each bridge module 6 is 450 mm wide, 821 mm long, 235 mm deep and weighs approximately 12 kg. A module of this size and weight can readily be carried by one man and indeed it is equally feasible for two such modules to be carried simultaneously by one man. By way of example FIGS. 5 and 6 illustrate a rucksack 40 designed for the carriage of such bridge modules comprising a body portion 41 sized and shaped to receive a module 6, a closure flap 42 with fasteners 43 to secure the load in the body 41, shoulder straps 44 for positioning the load for carrying on a person's back, and additional lifting handles 45 and 46 on the body and flap. FIG. 7 shows a dual arrangement 47 effectively comprising two such rucksacks fitted together to carry two bridge modules 6 on a person's back.

Figure 8:
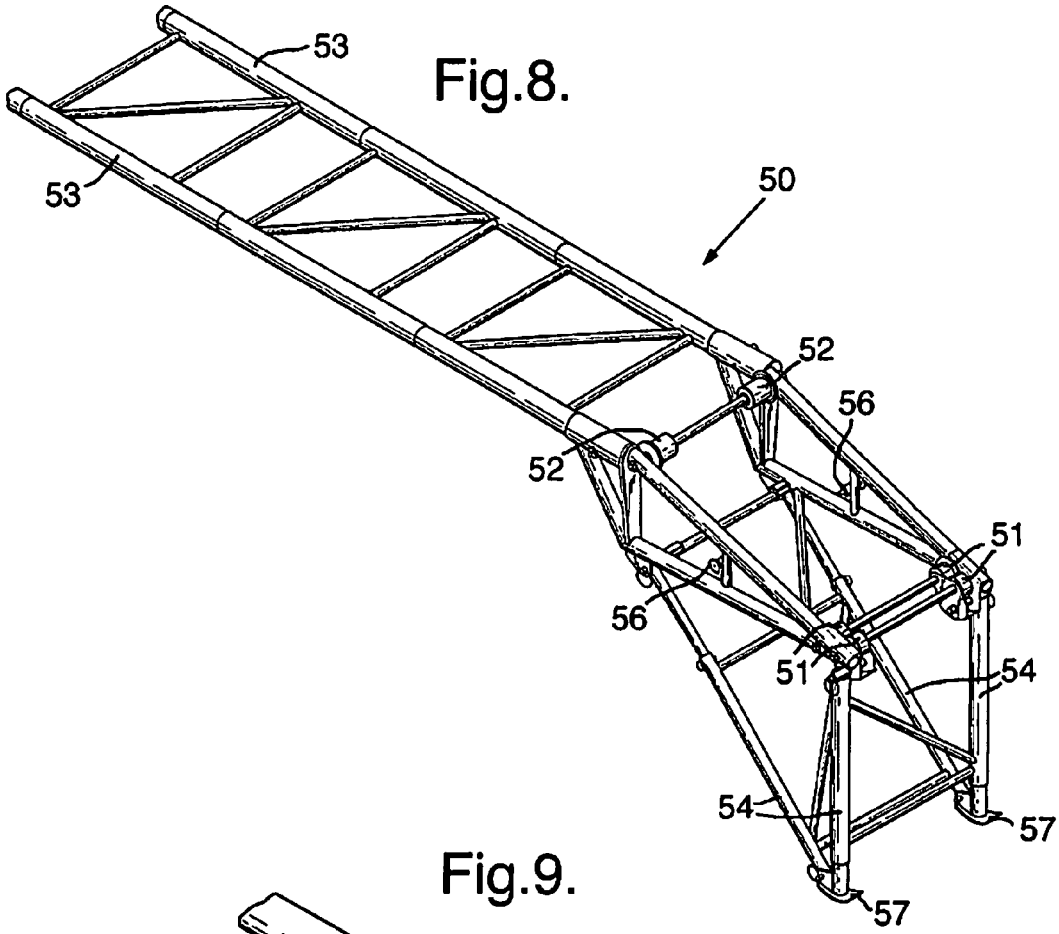
FIG. 8 is a three-quarters view of a preferred form of launch frame for use in the deployment of a bridge according to the invention.
Figure 9:
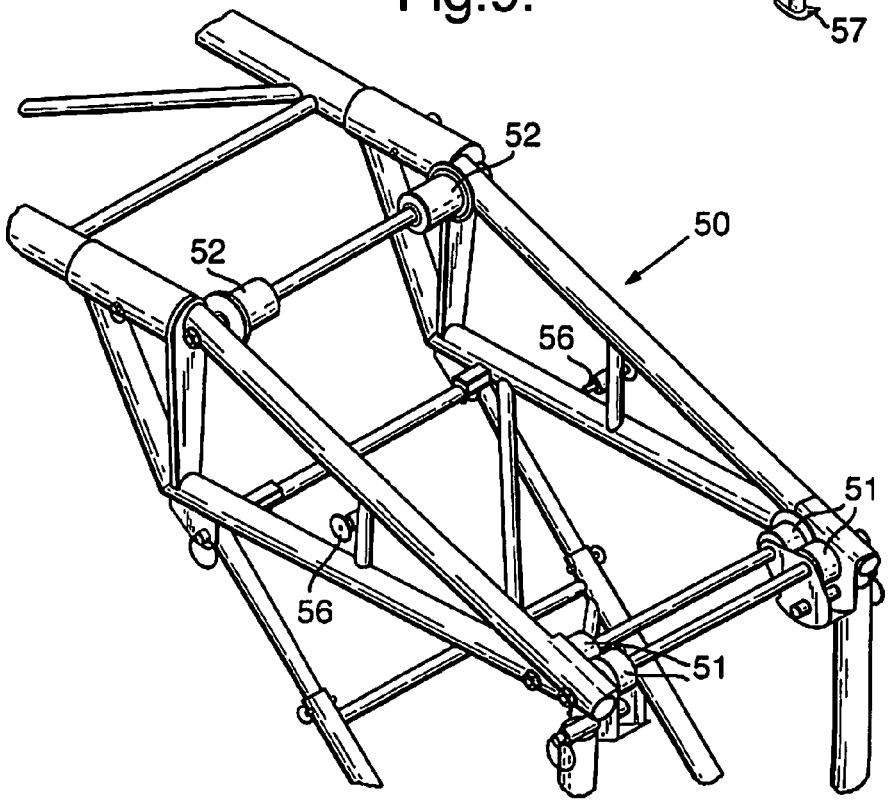
FIG. 9 shows part of the frame of FIG. 8 to a larger scale.
Figure 10:
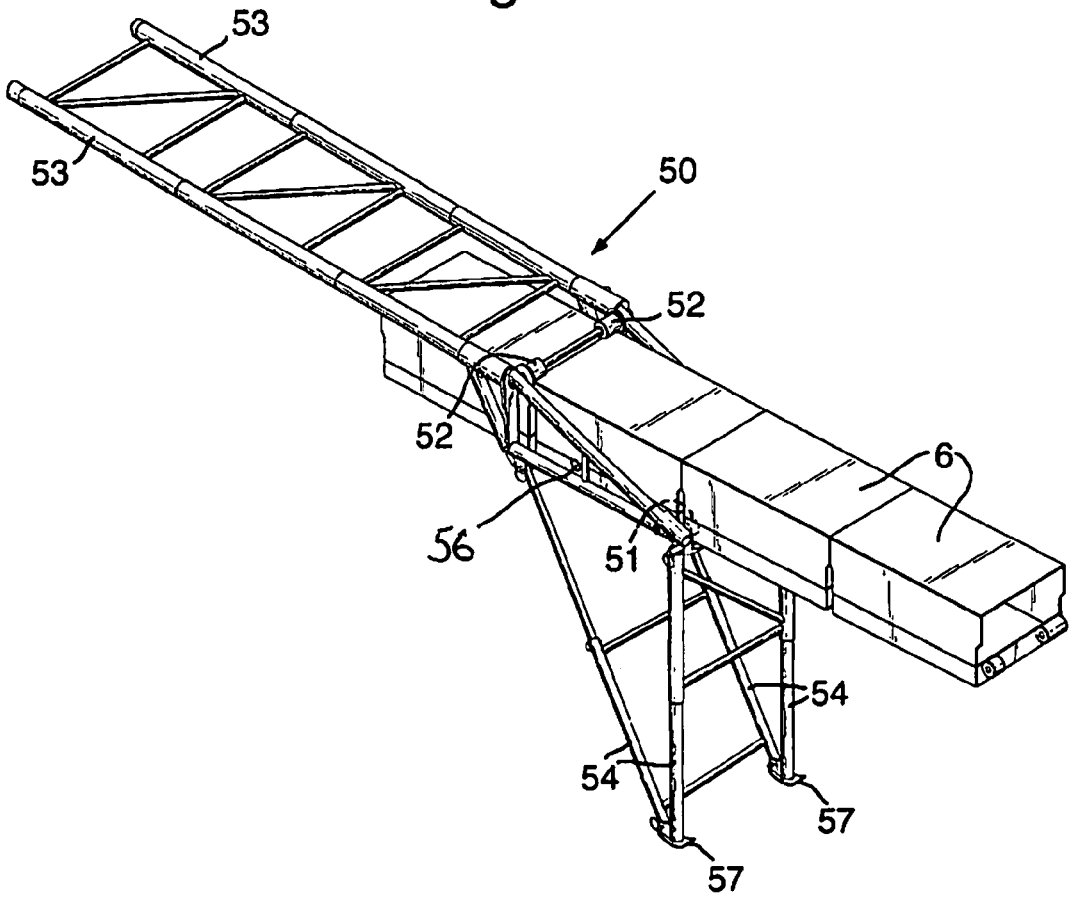
FIGS. 10 and 11 illustrate the use of the launch frame respectively in floor-standing and window sill mounted configurations.
Figure 11:
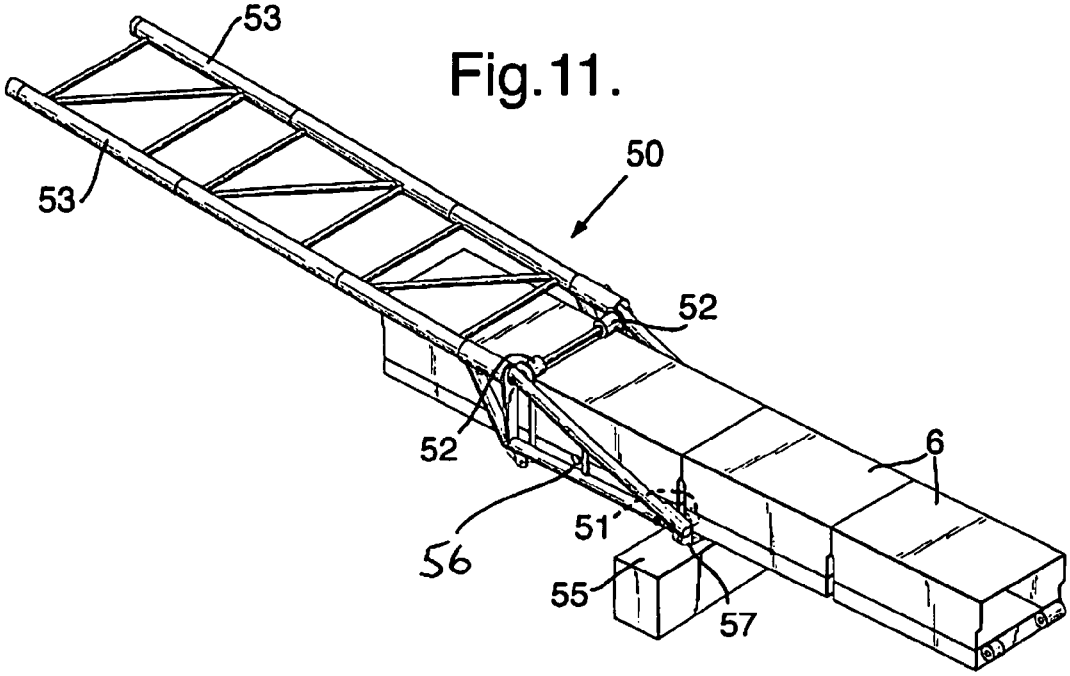

Turning to FIGS. 8 and 9 there is illustrated a launch frame 50 for use in the deployment of a bridge constructed from modules 6. This frame carries a double set of rollers 51 at its forward end and a further set of rollers 52 spaced behind and above the rollers 51. The distance between the outer flanges of the opposed rollers in each set and the distance by which the rear rollers 52 are located above the front rollers 51 are related to the dimensions of the bridge modules 6 such that a string of modules 6 can be supported in and guided through the frame 50 with their lower chords 8 running on the front rollers 51 and their upper chords 7 running on the rear rollers 52, e.g. as depicted in FIGS. 10 and 11. Behind and above this module-receiving section the frame is extended rearwardly to provide arms 53 for use in counterbalancing the load in the frame, and an optional set of adjustable-height legs 54 are provided beneath the receiving section. The legs 54 can be used for supporting the frame 50 on a surface behind an obstacle over which a bridge is to be deployed—for example on the floor of the room behind the window 2 in the case of FIG. 1—but can be dispensed with if the window sill (or other conveniently located surface) is itself sufficiently strong and stable to provide a platform for the launch frame, e.g. as notionally indicated at 55 in FIG. 11. A pair of inwardly-directed spring-biased pins 56 are provided in the frame midway between the front and rear rollers for a purpose to be described hereinafter.

In one embodiment of a launch frame 50 constructed substantially as described above with reference to FIGS. 8 and 9, sized to accept bridge modules of the dimensions previously exemplified and having counterbalance arms 53 2.16 m long, the frame is made principally from welded aluminium tubing in six parts which can be assembled together as shown, and held together by pinned joints, when required for use. Three of these parts make up the counter balance arms 53, two make up the legs 54 and the other comprises the receiving section. The total weight is approximately 39 kg and all the parts can be packed together and carried by one man if required. Alternative materials which could be used to produce a lighter launch frame include aluminium lithium alloy and composites.

Figure 12:
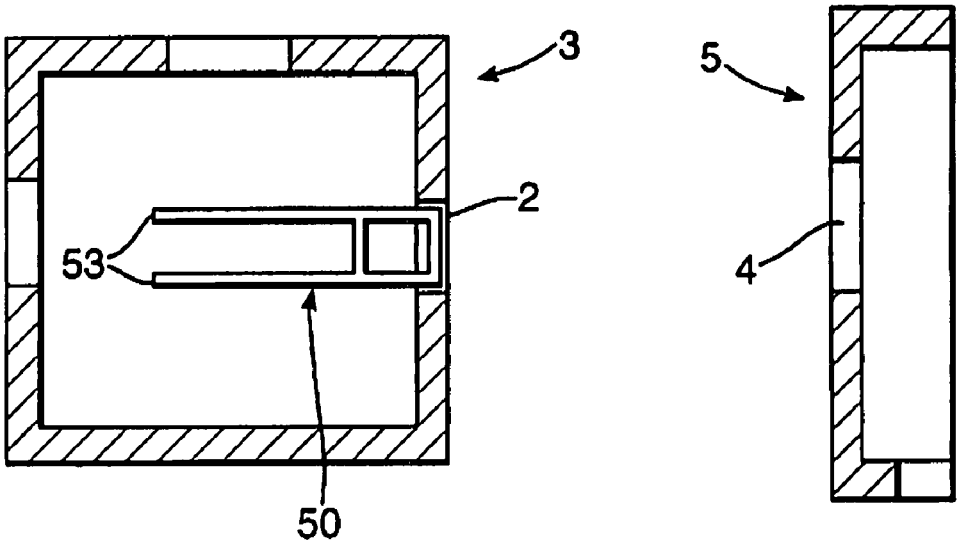
FIGS. 12 to 18 are schematic plan views of respective phases of a deployment process for a preferred form of bridge according to the invention.

To deploy a bridge using the equipment designed above the launch frame 50 is first assembled at the required site on the "home" side of the gap to be crossed and facing in the direction in which it is desired to project the bridge modules 6. This is illustrated schematically in FIG. 12 where the frame 50 has been set up supported on the sill of window 2 of building 3 to deploy a bridge through the window 4 of building 5. When assembling the frame 50 all or only some of the counterbalance arm sections may be used, depending on the length of the arms 53 which will be required to counterbalance the maximum load of bridge modules in the frame—or in other words the span of the gap to be crossed (therefore number of modules required)—and the number of personnel available for the task.

Figure 13:
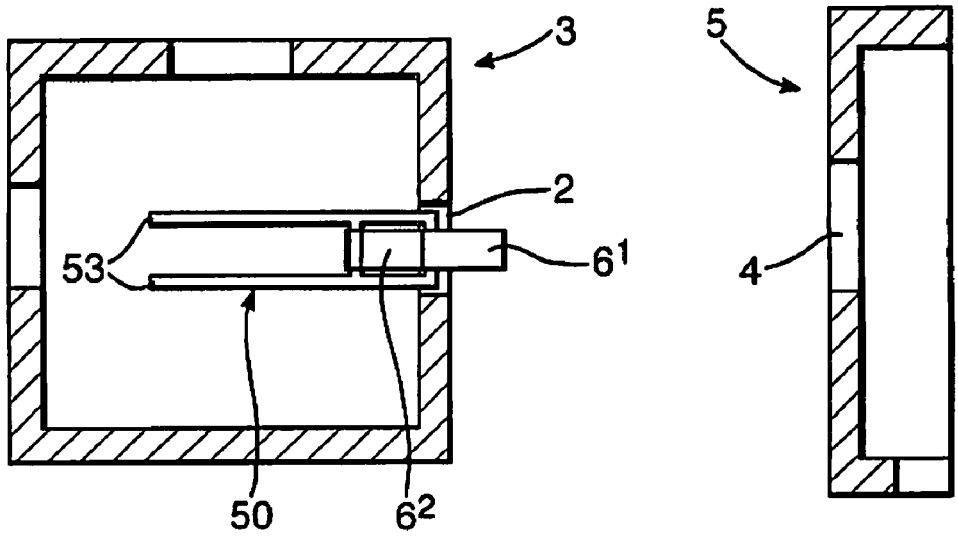

To start the deployment, one or a sub-assembly of more (typically up to four) bridge modules 6 are lifted and loaded into the receiving section of the frame 50 from the rear. For example FIG. 13 shows a sub-assembly of two bridge modules $\mathbf{6}^1$ and $\mathbf{6}^2$ which have been connected together with pins 25 and links 27 (FIGS. 3 and 4) and loaded into the frame 50. In this position the modules are retained in the frame by the spring-biased pins 56 (FIGS. 8 and 9) of the frame extending into the holes 32 (FIG. 3) in the sides of the module $\mathbf{6}^2$.

Figure 14:
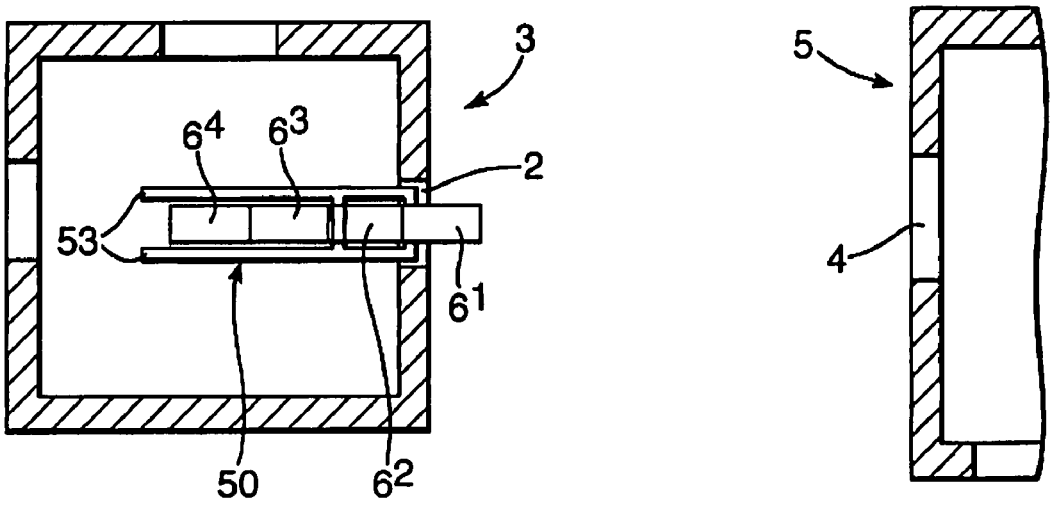
Figure 15:
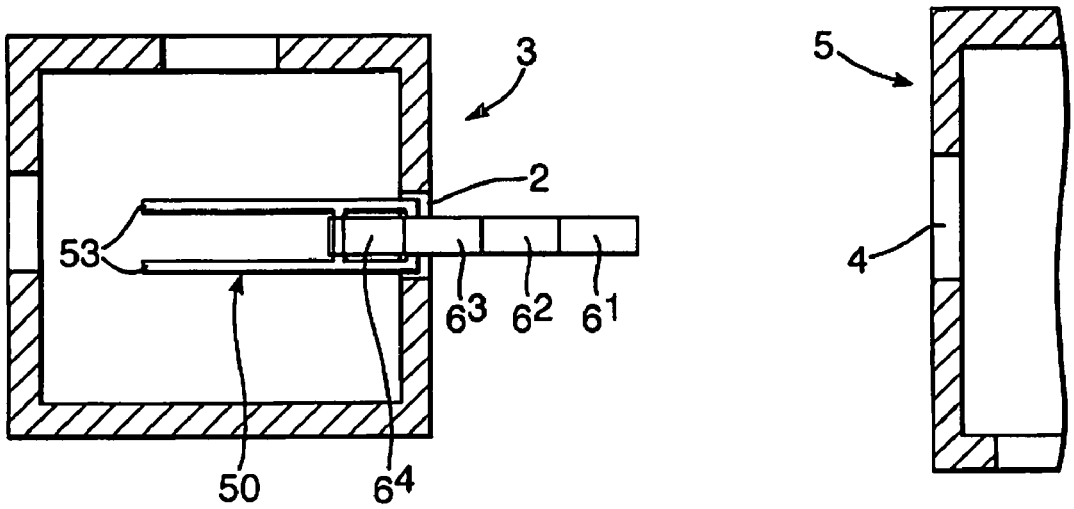

The deployment is continued by adding further modules 6, either individually or in sub-assemblies of more than one, to the rear of the existing string of modules held in the frame 50 and pushing them forward towards the window 4. For example FIG. 14 shows a sub-assembly of two modules $\mathbf{6}^3$ and $\mathbf{6}^4$, which have been connected together with pins 25 and links 27, lifted into position behind the sub-assembly $\mathbf{6}^1/\mathbf{6}^2$ and ready to be connected. From this position module $\mathbf{6}^3$ is connected to module $\mathbf{6}^2$ with pins 25 and links 27, the stopper pins 56 are pulled out from module $\mathbf{6}^2$, the string of modules $\mathbf{6}^1$-$\mathbf{6}^4$ is pushed forwards on the rollers in frame 50, and the pins 56 are released to engage in the holes 32 of module $\mathbf{6}^4$ when it reaches the corresponding position in the frame. This condition is shown in FIG. 15.

Figure 16:
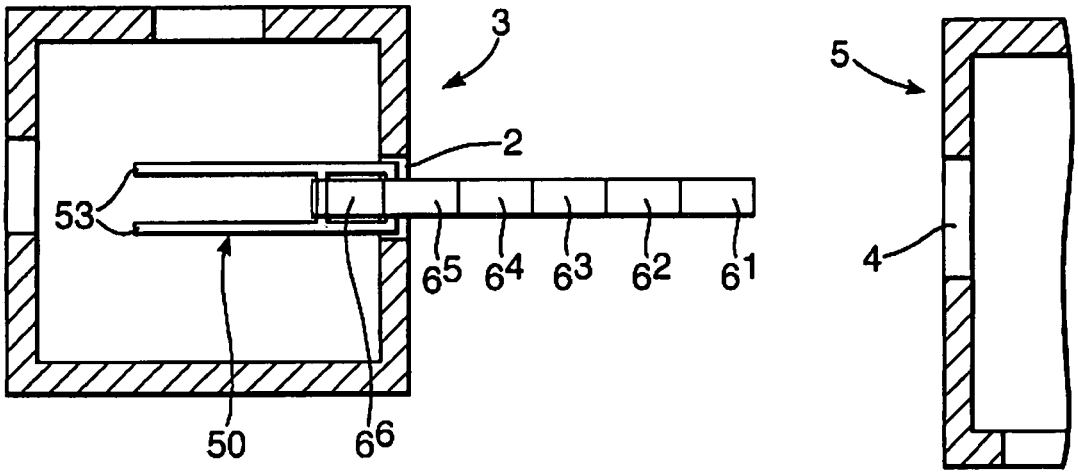
Figure 17:
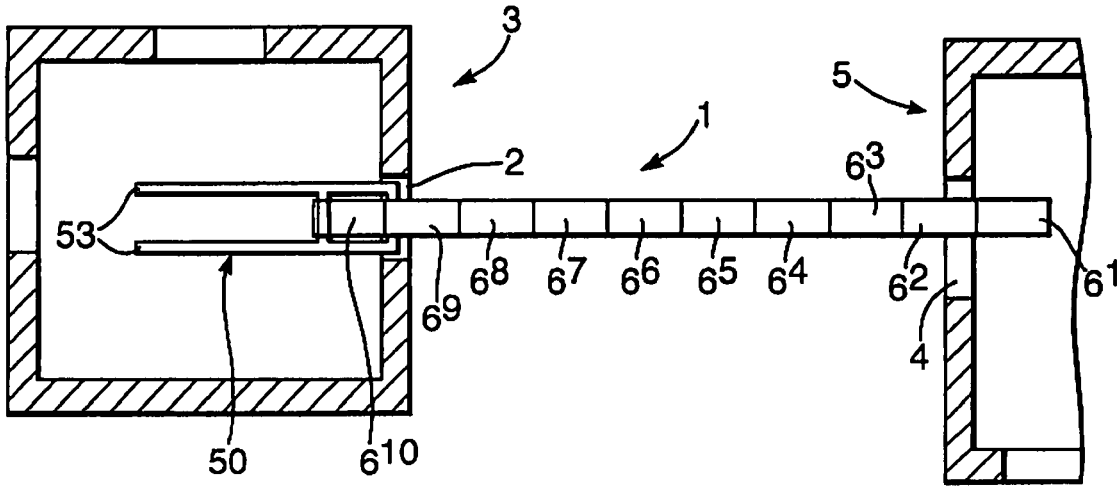
Figure 18:
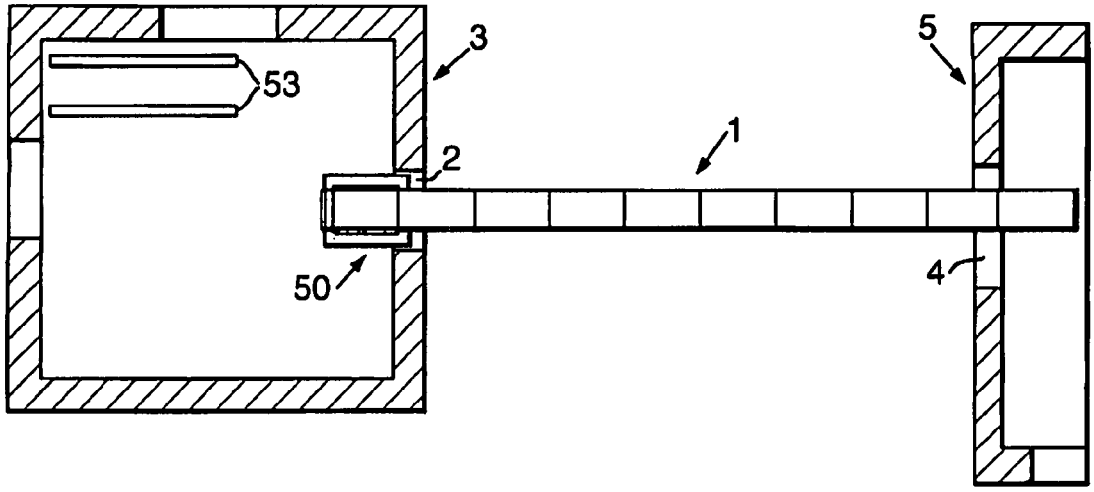

This process is repeated with further modules being added to the string and pushed out in the same way. For example FIG. 16 shows the condition where two further modules $\mathbf{6}^5$ and $\mathbf{6}^5$ have been added and FIG. 17 shows the condition in which a total of ten modules $\mathbf{6}^1$-$\mathbf{6}^{10}$ have been connected together and projected across the gap to reach the window 4. In this condition the counterbalance arms can be removed from the frame 50 and the bridge 1 is ready for use as indicated in FIG. 18.

The whole process of assembling the frame 50, connecting bridge modules 6 together, loading them into the frame, operating the pins 56, and pushing the module string through the frame, can be performed manually and without the use of special (or indeed any) tools. Throughout the operation until the completed bridge rests on the other side of the gap, the weight of the modules cantilevered from the frame 50 is counterbalanced by one or more persons holding or pressing down on the arms 53. These arms can also be used to tilt the frame somewhat in a vertical plane 4 (the feet 57 on which the frame stands being curved to facilitate rocking movement), to lift or lower the distal end of the string of modules as may be required for example to compensate for cantilever droop or to position that end on a surface on the far side of the gap which is at a different level to the home side. Furthermore, except when withdrawn for intentional movement of the module string towards the far side, the stopper pins 56 are automatically engaged with the rearmost module in the frame 50 to prevent any danger of the modules "running away" or otherwise shifting undesirably in the frame.

By way of example the frame components and modules to construct a ten-module bridge 1 substantially as described above can be transported by a team of six men (five each carrying two modules 6 and the sixth carrying the components to assemble frame 50), and tests have shown that an experienced team can deploy such a bridge in under five minutes. With modules of the dimensions exemplified above this can safely span a gap of up to 7.25 m, and wider gaps can be spanned by increasing the number of modules.

Figure 19:
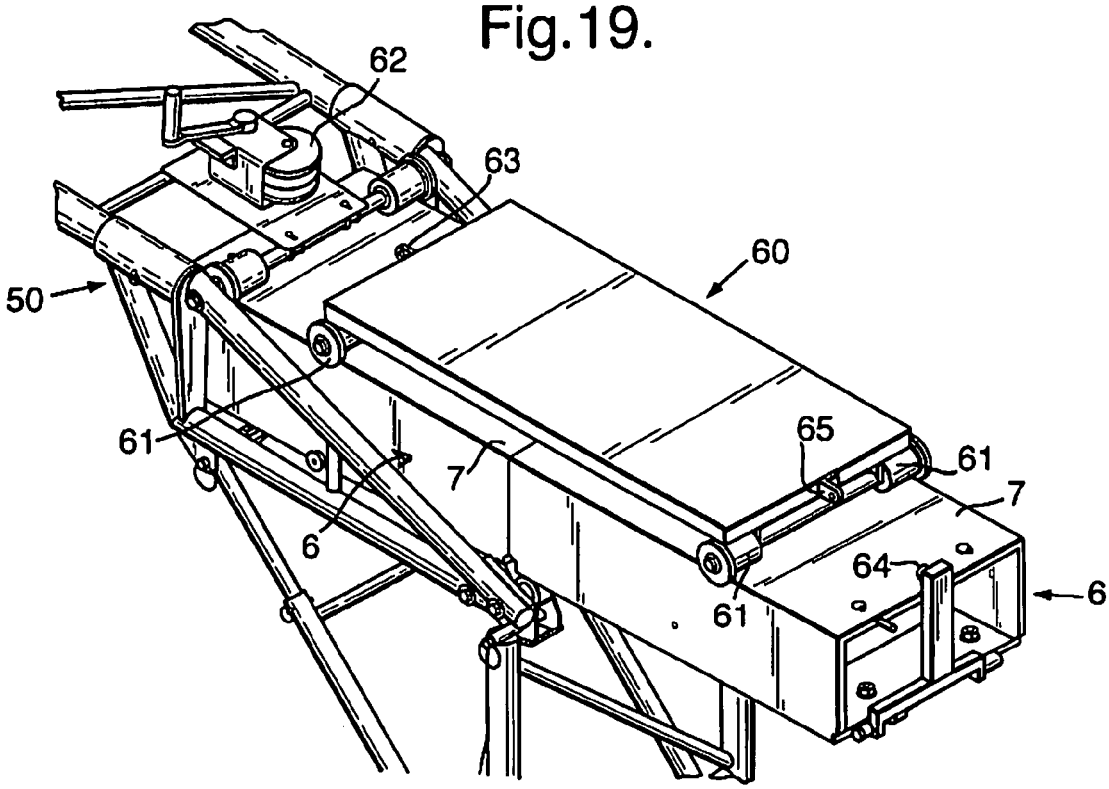
FIG. 19 is a three-quarters view of a preferred form of trolley system for use with a bridge according to the invention.

The completed bridge 1 presents a substantially continuous deck provided by the abutting upper chords 7 of the modules 6, suitable for foot traffic as indicated in FIG. 2. As an alternative, e.g. for transporting supplies or evacuating casualties across the bridge, a trolley system can be used as indicated in FIG. 19 where a trolley 60 has flanged wheels 61 running on the side edges of the chords 7 of modules 6. A trolley of this kind, or a train of linked trolleys of a combined length to take a stretcher for example, can be hauled across the bridge manually using ropes or by means of a winch 62. The winch may be attached to the launch frame 50 and comprise two drums: a first for winding a cable (not shown) attached to an eye 63 at the near end of the trolley, and a second for winding a cable (not shown) running under the trolley to a pulley 64 at the far end of the bridge and thence to an eye 65 at the far end of the trolley, so that the trolley can be pulled in both directions across the bridge by operation of a single winch at the "home" end, (it being understood that FIG. 19 illustrates the system in the course of deploying the first two modules 6 destined to be located at the far end of the completed bridge).

As and when it is required to disassemble the bridge 1 this can be effected by pulling in through the frame 50 and detaching the modules 6 effectively in the reverse of the deployment sequence exemplified in FIGS. 12-18.

Although a preferred procedure for deploying a bridge according to the invention from a relatively confined space has been described above with reference to FIGS. 12-18, where space permits it would alternatively be possible to assemble together all of the modules 6 required to span a particular gap and to project the assembly as a whole through the frame 50 in a single operation, thereby saving time compared to the described sequential adding of modules and projection of the assembly in stages.

Figure 20:
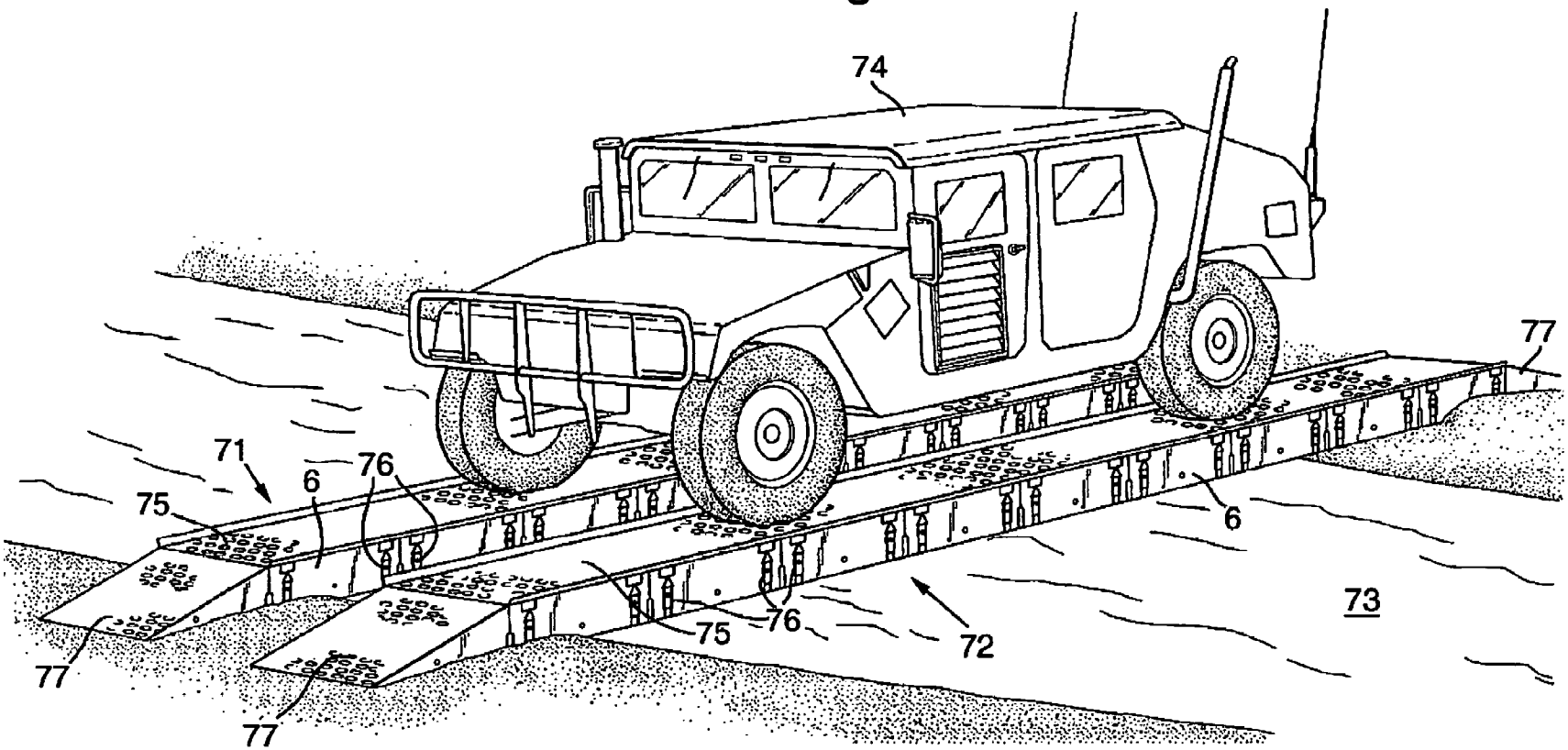
FIG. 20 is a perspective view of another bridge composed from the same form of modules as the bridge of FIG. 2, in this case for vehicular traffic.

Turning to FIG. 20, this shows a bridge comprising a pair of trackways 71 and 72 for crossing a gap (exemplified by a river 73) by motorised traffic (exemplified by the vehicle 74) and composed of bridge modules 6 of the same form as described above. In this case each trackway 71,72 comprises two parallel strings of nine bridge modules 6 connected end to end, with the module strings in each trackway strapped together side by side and overlaid with a separate perforated track 75 to provide grip for vehicle tyres. Webbing straps 76 attached to the tracks 75 loop around and under the respective modules 6 and back to the tracks to keep whole of each trackway assembly together. The bridge is completed by ramps 77 at each end of each trackway to enable vehicles to pass onto and of from the structure at the opposite banks of river 73. The assembly of each string of modules 6 in this case may be accomplished by use of a frame 50 of the kind described above, which is then separated completely from the modules, or by other means.

What is claimed is:

1. Means for the construction of a bridge comprising: a plurality of man-portable bridge modules adapted to be connected together in linear succession, on one side of a gap to be spanned, and projected in cantilever fashion from that side of the gap until the assembly of modules spans the gap to form a bridge capable of supporting human traffic; and a man-portable apparatus, or plurality of man-portable components adapted to be assembled into an apparatus, adapted to support and guide the cantilevered assembly of bridge modules as it is projected across the gap, said apparatus comprising a receiving portion through which such bridge modules can be passed successively to project an assembly of such modules as aforesaid and within which the proximal end of such assembly is in use supported; and lever arm means adapted to be held by one or more persons and extending from said receiving portion in the direction opposite to the direction in which such assembly is in use projected, whereby to counterbalance such assembly while projected as aforesaid.

2. Means according to claim 1 comprising means for connecting such bridge modules together in demountable fashion.

3. Means according to claim 1 wherein such bridge modules are of generally rectangular box section.

4. Means according to claim 3 wherein the box section of such bridge modules is generally open ended in the longitudinal direction of the bridge.

5. Means according to claim 3 wherein, in use, the upper surfaces of such bridge modules collectively provide a substantially continuous deck.

6. Means according to claim 3 wherein such bridge modules comprise brackets to resist shear loads attached internally of the box section.

7. Means according to claim 3 wherein, in use, adjacent such bridge modules are connected together in the region of their lower surfaces by pin joints extending transversely to the longitudinal direction of the bridge and so that upper portions of adjacent such modules abut under longitudinal compression in normal use of the bridge.

8. Means according to claim 3 wherein, in use, adjacent such bridge modules are connected together in the region of their upper surfaces by links adapted to resist longitudinal tension between adjacent such modules while projected as aforesaid.

9. Means according to claim 1 wherein such bridge modules are constructed principally of a fibre reinforced plastic material.

10. Means according to claim 9 wherein such bridge modules are constructed principally of sandwich material comprising skins of fibre reinforced plastic separated by a core material.

11. Means according to claim 1 wherein said receiving portion comprises rollers adapted to bear such bridge modules for translation.

12. Means according to claim 1 wherein said receiving portion and bridge modules are adapted to selectively interlock to prevent movement of such modules through said portion.

13. Means according to claim 1 wherein said apparatus is configured such that said receiving portion can be tilted to raise or lower an assembly of bridge modules while projected as aforesaid, by operation of said lever arm means.

14. Means according to claim 1 wherein said apparatus is adapted for freestanding use on a supporting surface.

15. Means according to claim 1 further comprising a wheeled trolley adapted to run on an assembly of such bridge modules.

16. A method of constructing a bridge capable of supporting human traffic by use of means according to claim 1, the method comprising the steps of:

(a) loading one or more such bridge modules into the receiving portion of said apparatus;

(b) connecting one or more further such bridge modules to the proximal end of the first-mentioned module or assembly of modules and shifting the resultant assembly of modules with respect to said receiving portion so that the distal end of the assembly projects from the apparatus while the proximal end of the assembly is supported in the receiving portion;

(c) connecting one or more further bridge modules to the proximal end of the existing assembly of modules and shifting the resultant assembly with respect to said receiving portion so that its distal end projects further from the apparatus while its proximal end is supported in said receiving portion; and (d) repeating step (c), if necessary, until said assembly spans the gap;

all while counterbalancing the projected assembly of bridge modules by use of said lever arm means.

17. A method according to claim 16 performed solely by manpower.

18. A bridge constructed by use of means according to claim 1.

19. A bridge constructed by a method according to claim 16.

* * * * *